US008113910B2

(12) United States Patent
Fortner

(10) Patent No.: US 8,113,910 B2
(45) **Date of Patent: *Feb. 14, 2012**

(54) ADHERABLE GARMENT PADS

(76) Inventor: Paige Fortner, Everett, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/845,016

(22) Filed: Aug. 24, 2007

(65) Prior Publication Data

US 2007/0289047 A1 Dec. 20, 2007

Related U.S. Application Data

(63) Continuation of application No. 10/631,089, filed on Jul. 30, 2003, now abandoned.

(60) Provisional application No. 60/399,967, filed on Jul. 30, 2002.

(51) Int. Cl.
*A41C 3/00* (2006.01)

(52) U.S. Cl. ..... 450/81; 450/39; 450/57

(58) Field of Classification Search ..... 450/92, 450/36–39, 54–58, 81; 2/244, 246, 262, 2/268

See application file for complete search history.

(56) References Cited

U.S. PATENT DOCUMENTS

| | | | | |
|---|---|---|---|---|
| 2,376,777 A | | 5/1945 | Kallander | |
| 2,411,328 A | | 11/1946 | MacNab | |
| 2,568,175 A | * | 9/1951 | Ullrich | 450/54 |
| 3,348,549 A | * | 10/1967 | Brodmann et al. | 450/57 |
| 3,464,418 A | * | 9/1969 | Silverman | 450/57 |
| 3,738,362 A | | 6/1973 | Sneider | |
| 3,749,102 A | | 7/1973 | Wynants | |
| 4,654,254 A | | 3/1987 | Gerry | |
| 4,674,131 A | * | 6/1987 | Broel | 2/105 |
| 4,674,510 A | | 6/1987 | Sneider | |
| 5,326,305 A | | 7/1994 | Fochler | |
| 5,569,345 A | | 10/1996 | Kenyon | |
| 5,693,164 A | | 12/1997 | Chang | |
| 5,716,255 A | | 2/1998 | Abercrombie | |
| 5,755,611 A | | 5/1998 | Noble | |
| 5,858,014 A | | 1/1999 | Kepes | |
| 5,983,394 A | | 11/1999 | Joo | |
| 6,014,771 A | | 1/2000 | Kirven | |
| 6,074,272 A | | 6/2000 | Hebert | |

(Continued)

FOREIGN PATENT DOCUMENTS

CA 2089855 A1 8/1994

(Continued)

OTHER PUBLICATIONS

EPO Examination Report dated Jun. 1, 2007, issued in corresponding Application No. EP 03772169.3, filed Jul. 30, 2003.

(Continued)

*Primary Examiner* — Gloria Hale

(74) *Attorney, Agent, or Firm* — Christensen O'Connor Johnson Kindness PLLC

(57) ABSTRACT

A garment pad kit for coupling a garment pad (20A, 20B, 120A, or 120B) to a garment (11 or 102) is provided. The garment pad kit includes a garment pad (20A, 20B, 120A, or 120B) having a body portion (23 and 123) having an adhering surface (19, 21, 119, and 121) disposed on the body portion. The garment pad kit further includes an adhesive (33, 34, 133, or 134) for coupling the adhering surface to a garment (11 or 102).

12 Claims, 7 Drawing Sheets

U.S. PATENT DOCUMENTS

| | | | |
|---|---|---|---|
| 6,419,548 | B1 | 7/2002 | Wittes |
| 6,758,720 | B2 | 7/2004 | Chen |
| 6,780,081 | B2 | 8/2004 | Chen |
| 6,852,001 | B2 | 2/2005 | Chen |
| 6,857,932 | B2 | 2/2005 | Chen |
| 6,916,224 | B2 | 7/2005 | Chen |

FOREIGN PATENT DOCUMENTS

| | | | |
|---|---|---|---|
| GB | 2 206 154 | A | 12/1988 |
| JP | 07300702 | A | 11/1995 |
| JP | 2001020115 | A | 1/2001 |

OTHER PUBLICATIONS

EPO Examination Report dated Dec. 21, 2007, issued in corresponding Application No. EP 03772169.3, filed Jul. 30, 2003.
EPO Examination Report dated Jul. 9, 2009, issued in corresponding Application No. EP 03772169.3, filed Jul. 30, 2003.
EPO Examination Report dated Jun. 12, 2008, issued in corresponding Application No. EP 03772169.3, filed Jul. 30, 2003.

* cited by examiner

ADHERABLE GARMENT PADS

CROSS-REFERENCES TO RELATED APPLICATIONS

This application is a continuation of U.S. patent application Ser. No. 10/631,089, filed Jul. 30, 2003, and claims the benefit of U.S. Provisional Application No. 60/399,967, filed Jul. 30, 2002, the disclosure of which is hereby expressly incorporated by reference in its entirety, and priority from the filing date of which is hereby claimed under 35 U.S.C. §119.

FIELD OF THE INVENTION

The present invention relates generally to garment pads and, more particularly to, garment pads which may be selectively adhered to a garment.

BACKGROUND OF THE INVENTION

Often, a purchaser of a garment desires to adjust the appearance of the garment to produce a more aesthetically pleasing shape to the garment or to enhance the appearance or shapeliness of a portion of the wearer's body. For instance, it is well known that bras provide the shapeliness and breast support desired by many women. However, when a bra is worn with certain types of garments, such as summer tops, dresses, and swimsuits, the straps or other such portions of the bra may be visible, resulting in an unsightly appearance. Further, the support structures of the bra, such as underwires, straps, and fasteners, can be uncomfortable.

One solution to these problems is a shelf bra. The shelf bra is a simple bra structure that is sewn into a garment and is usually comprised of an extra layer of fabric having a bottom elastic band, which secures under the breasts and engages the rib cage. Although the shelf bra works for its intended purpose, it is not without problems. For instance, the shelf bra does not provide the support and structure required to shape the breasts to provide a pleasing appearance, tending to instead provide an unflattering flattened appearance to the breasts. Further, the shelf bra does not provide sufficient coverage for the breasts of the user, allowing the shape of the nipple to show through the shelf bra and outer garment.

If a woman does not want to sacrifice shapeliness, coverage and additional support, she previously had to resort to wearing a conventional bra underneath her top or dress. This in turn posed a variety of problems including the unsightliness of exposed bra straps and/or other bra components, as well as the standard discomforts associated with wearing a conventional bra, i.e., underwires, back hooks, tight elastic and inflexible material. An alternative to wearing a conventional bra under the top is to wear removable cups or pads. By doing so, the wearer subjects herself to the possibility of being embarrassed and/or humiliated if the cups become displaced or, even worse, fall out. There is also the option of sewing the cups in place, which requires special skills and equipment that the majority of women do not have the time or the skill to complete.

Further a purchaser of a garment may desire to adjust the appearance of a garment in other ways to produce a more aesthetically pleasing shape to the garment or to enhance the appearance or shapeliness of a portion of the wearer's body. For instance, it is well known that shoulder pads may be added to a garment to enhance the appearance of the shoulders of the user. However, not all garments come with shoulder pads installed therein. Further, even with regard to garments that come with shoulder pads either permanently installed or detachably coupled to the garment, the pads may become lost, such as during dry cleaning, worn out, or the user may wish to change the shape of the pads to provide a different aesthetically pleasing shape than provided by the original shoulder pads. One solution has been to sew shoulder pads in place. However, this requires special skills and equipment that the majority of people do not have the time or the skill to complete.

Thus, there exists a need for a garment pad, such as a bra pad or shoulder pad, that is readily couplable to a garment by a person unskilled in the art of sewing.

SUMMARY OF THE INVENTION

In accordance with one embodiment of the present invention, a garment pad kit for coupling a garment pad to a garment is provided. The garment pad kit includes a garment pad including a body portion having an adhering surface disposed on the body portion. The garment pad kit further includes an adhesive for coupling the adhering surface to a garment.

In accordance with another embodiment of the present invention, a garment is provided. The garment includes a garment fabric layer, a garment pad, and an adhesive disposed between the garment fabric layer and the garment pad. The adhesive couples the garment pad to the garment fabric layer.

In accordance with still another embodiment of the present invention, a garment pad adapted to be selectively coupled to a garment is provided. The garment pad includes a body having an adhering surface disposed on the body, the adhering surface adapted to couple to a garment. The garment pad further includes a pressure sensitive adhesive disposed on the adhering surface of the body, wherein the pressure sensitive adhesive is adapted to temporarily couple the garment pad to a garment when subjected to a pressure above a selected pressure. The garment pad also includes a temperature sensitive material disposed on the adhering surface of the body, wherein the temperature sensitive material is adapted to permanently couple the garment pad to a garment when the temperature sensitive material is heated above a selected temperature.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
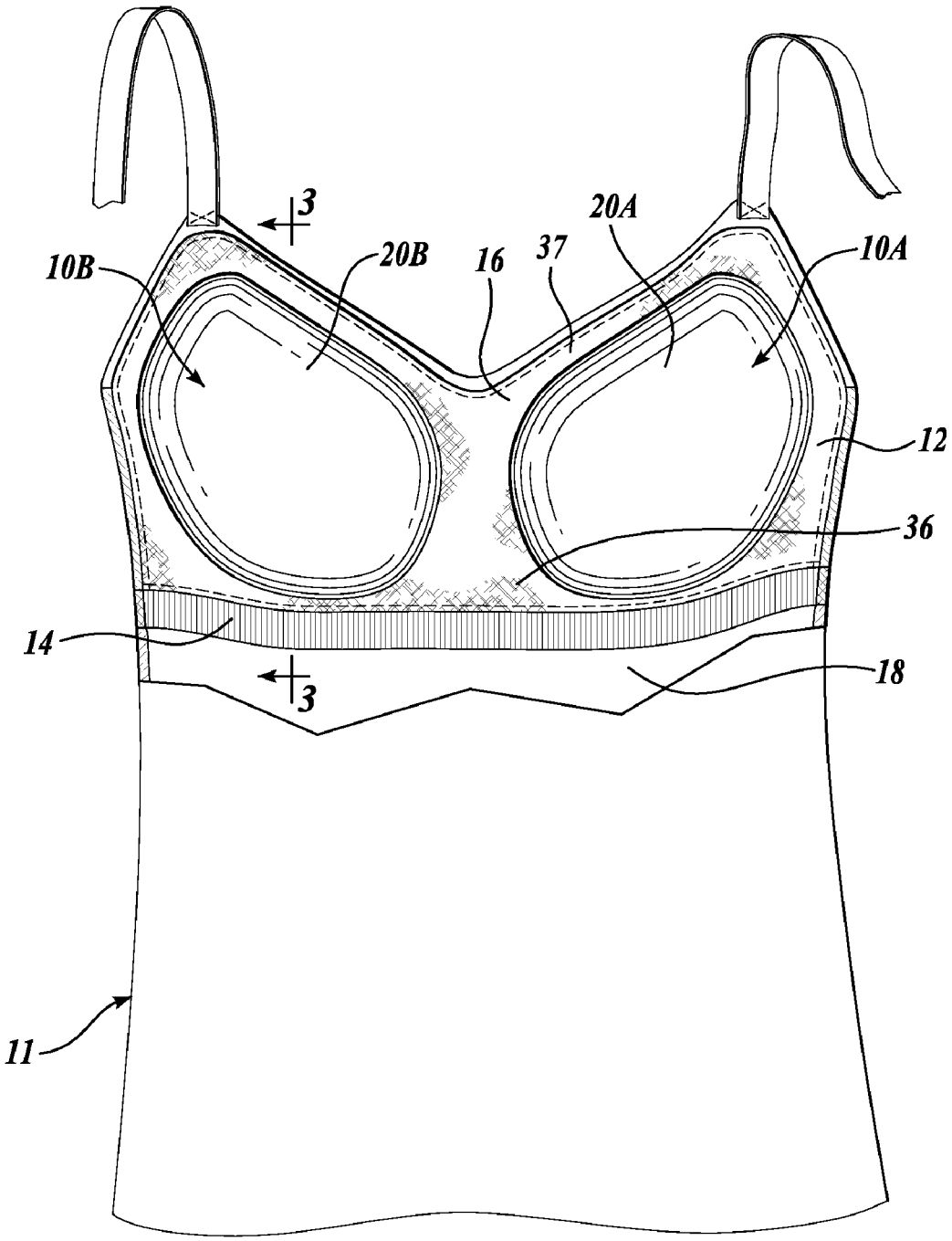
FIG. 1 is an elevation view of a garment having a shelf bra as viewed from the back side of the garment wherein a back portion of the garment has been removed to show an inner portion of the garment with the shelf bra including attached bra pad assemblies formed in accordance with one embodiment of the present invention, wherein the bra pad assemblies are attached to an inner surface of the shelf bra.
Figure 3:
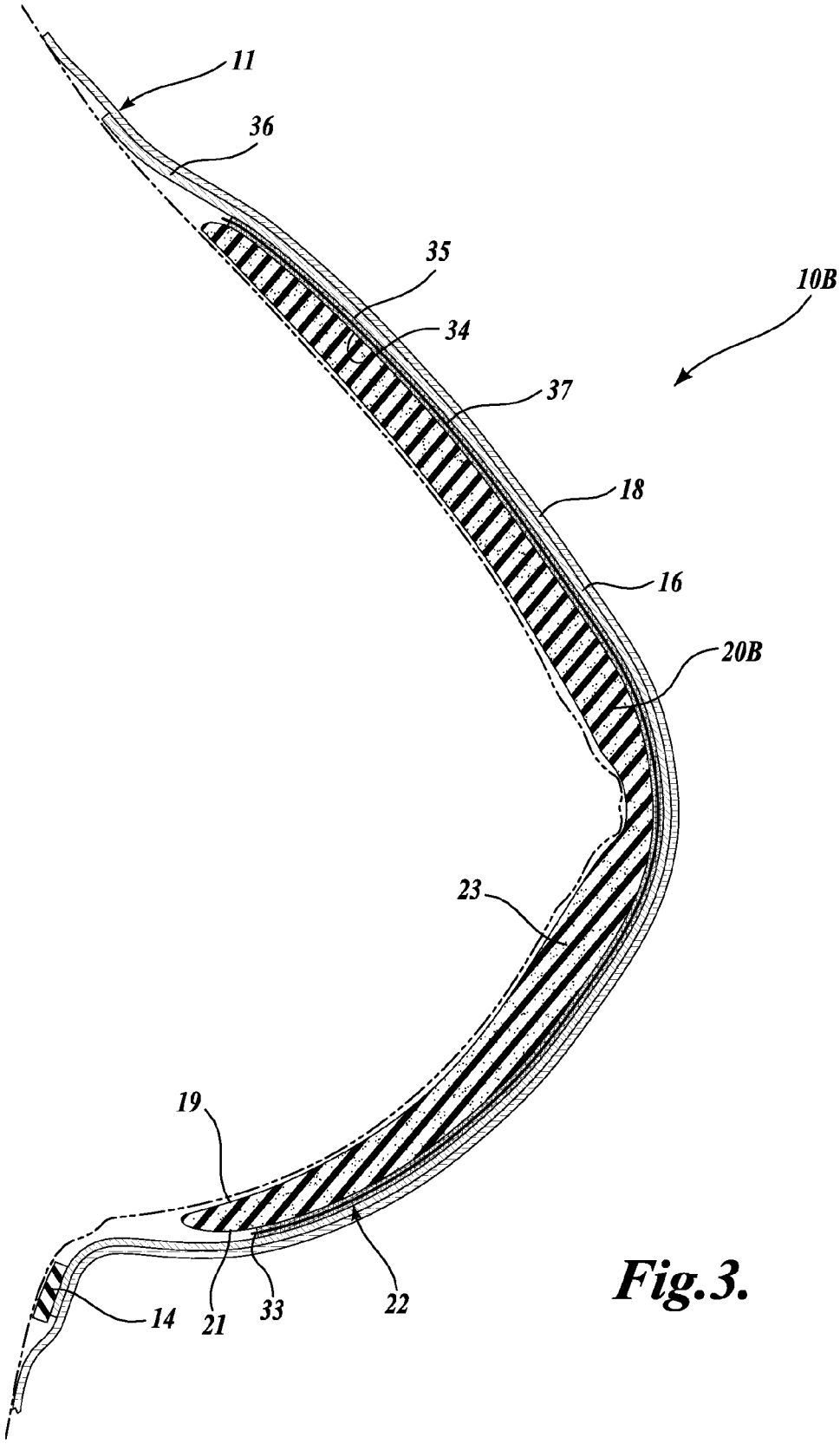
FIG. 3 is a cross sectional view of the garment, shelf bra, and one of the bra cup assemblies depicted in FIG. 1, wherein the cross sectional cut is taken substantially through SECTION 3-3 of FIG. 1 and a breast of the user is shown in phantom.
Figure 5:
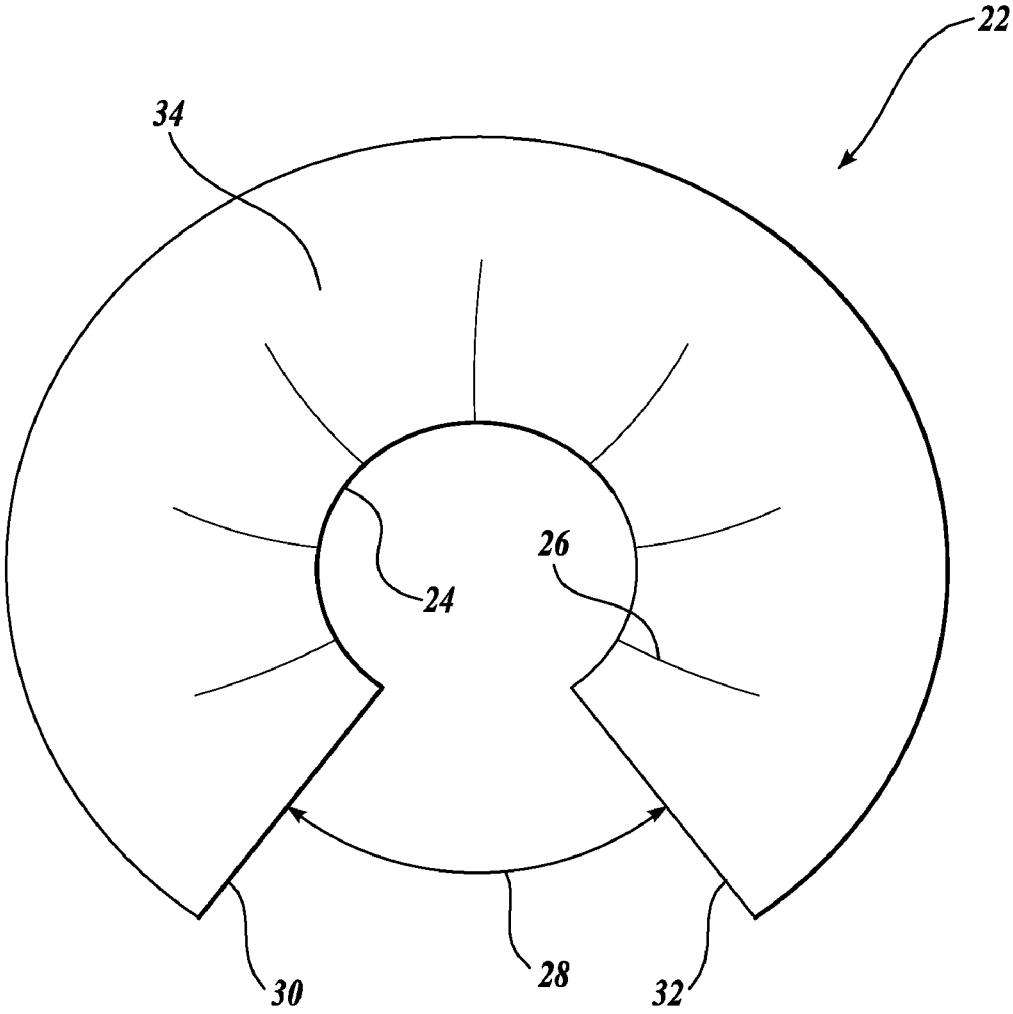
FIG. 5 is a top view of a section of bonding fabric formed in accordance with one embodiment of the present invention and suitable for use with the embodiments depicted in FIGS. 1-4.

Referring to FIGS. 1, 3 and 5, a first embodiment formed in accordance with the present invention is illustrated. Although the illustrated embodiment will be described herein in relation to a shelf bra 12, it should be apparent to one skilled in the art that the present invention has wide application and is suitable for use whenever it is desirable to adhere a garment pad to a garment 11. Depicted in FIGS. 1, 3 and 5 are a pair of bra pad assemblies 10A and 10B each comprised of a bra pad 20A or 20B and a section of bonding fabric 22. The bra pads 20A and 20B may be formed from foam or other soft, pliable material, one suitable material being polyurethane foam, to form a body portion 23. The bra pads 20A and 20B may be generally domed shaped to conform to and/or provide shapeliness to a woman's breasts. More specifically, the bra pads 20A and 20B each have an inner seamless, curved, continuous, unbroken concave surface and an outer seamless, curved, continuous, unbroken convex surface and a body portion extending therebetween. Further, the bra pads 20A and 20B may be trimmed to a custom shape and/or size by a user or manufacturer.

The bra pads 20A and 20B may be adhered to a garment through the sections of bonding fabric 22. In reference to FIG. 5, the sections of bonding fabric 22 may be generally circular in shape. A center aperture 24 may be centrally located in the bonding fabric 22. A plurality of relief cuts 26 may be oriented substantially radially outward from the center of the bonding fabric 22. Further, a relief gap 28 may be formed in the bonding fabric 22 such as by removing a triangular shaped portion of the bonding fabric 22 by cutting along edges 30 and 32. The center aperture 24, relief cuts 26, and relief gap 28 work in combination to allow the substantially planar bonding fabric 22 to be readily configured to a dome shaped configuration which corresponds to the dome shaped configuration of the bra pads. The bonding fabric 22 may be pre-cut by a manufacturer or cut by an end user in order to accommodate a variety of bra pads, having various shapes and/or sizes.

Referring to FIGS. 1 and 3, the bonding fabric 22 may include a support layer 33, such as a fabric, having a pressure sensitive adhesive layer 34 applied to one side of the support layer 33. The bonding fabric 22 may be hand-pressed onto the bra pads 20A and 20B through application of a pressure above a selected pressure. The selected pressure is preferably the minimum pressure needed to activate the pressure sensitive adhesive 34 to bond to the bra pads 20A and 20B. The bonding fabric 22 may also include a second pressure sensitive adhesive layer 35 applied to a second side of the support layer 33. The bonding fabric 22 and attached bra pad 20B may be hand-pressed onto the shelf bra 12 through application of a pressure above the selected pressure.

The adhesive layers 34 and 35 provide a temporary hold while the user positions the bra pads 20A and 20B inside her garment. The temporary hold allows the bra pads 20A and 20B to remain in place until the user is ready to permanently bond the bra pads 20A and 20B to the shelf bra 12. The bonding fabric includes a temperature or heat sensitive adhesive wherein the temperature or heat sensitive adhesive may be activated by the application of heat, such as by use of an iron, to permanently bond the bra pads 20A and 20B to an inner surface 37 of the shelf bra 12. The temperature or heat sensitive adhesive may be intermixed with the pressure sensitive adhesive layers 34 and 35, or may alternately be an integral part of the support layer 33. For instance, the support layer 35 may melt upon application of heat to bond the bonding fabric to a garment and/or bra pad 20A or 20B.

As should be apparent to one skilled in the art, the adherable bra pads 20A and 20B allow a wearer to adhere the bra pads directly to the shelf bra 12. This easy process rids the wearer of cup displacement fears, avoids the hassles of sewing the cups in place and, last but not least, eliminates the need for a conventional bra. The adherable bra pads 20A and 20B may be sold in combination with two pieces of bonding fabric 22 in a kit. Such a kit would provide a user with the ability to adhere the bra pads to a garment in a simple manner requiring very little, if any, skill.

Figure 2:
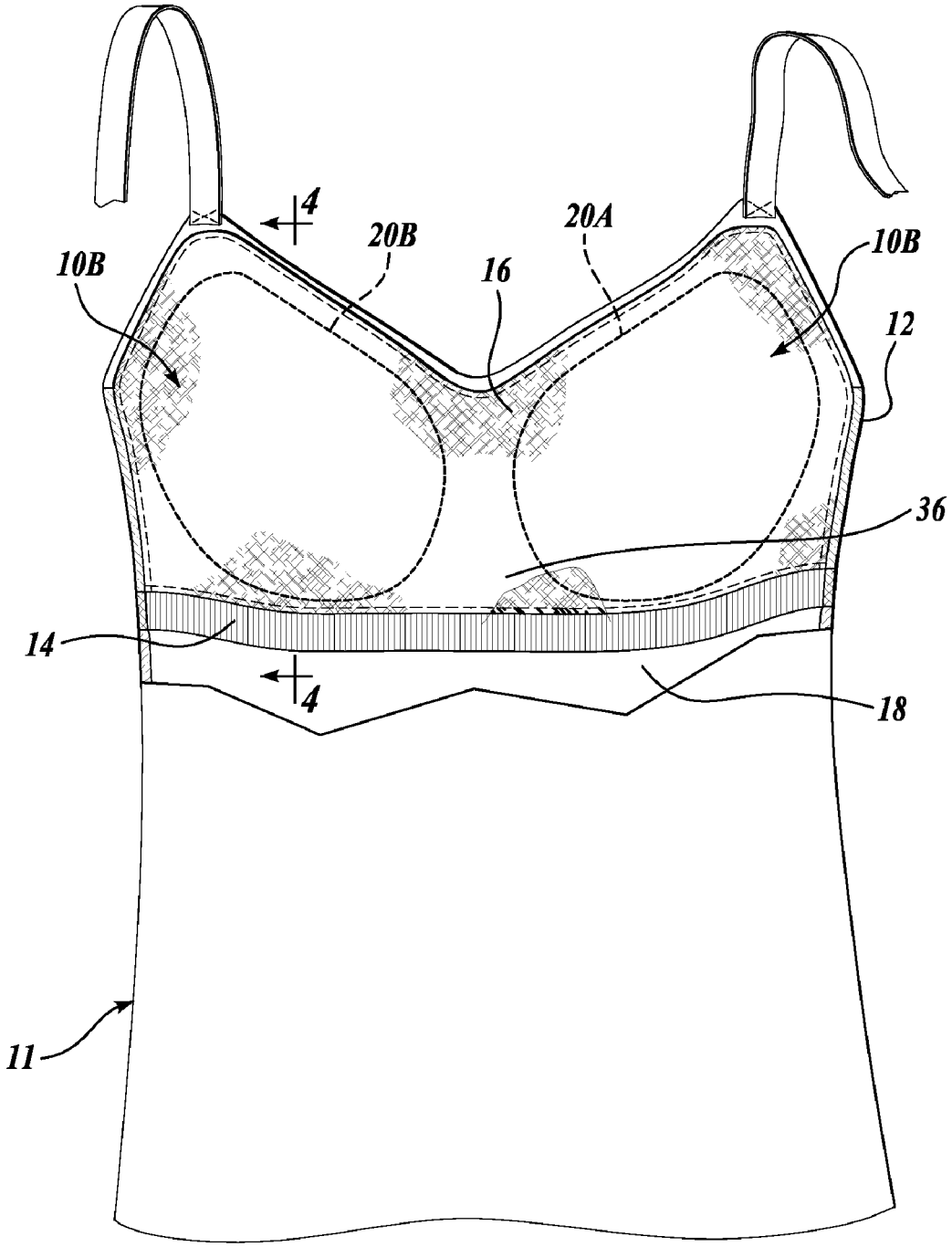
FIG. 2 is an elevation view of a garment having a shelf bra as viewed from inside the back side of the garment wherein a back portion of the garment has been removed to show an inner portion of the garment with the shelf bra including attached bra pad assemblies formed in accordance with one embodiment of the present invention, wherein the bra pad assemblies are attached to an outer surface of the shelf bra.
Figure 4:
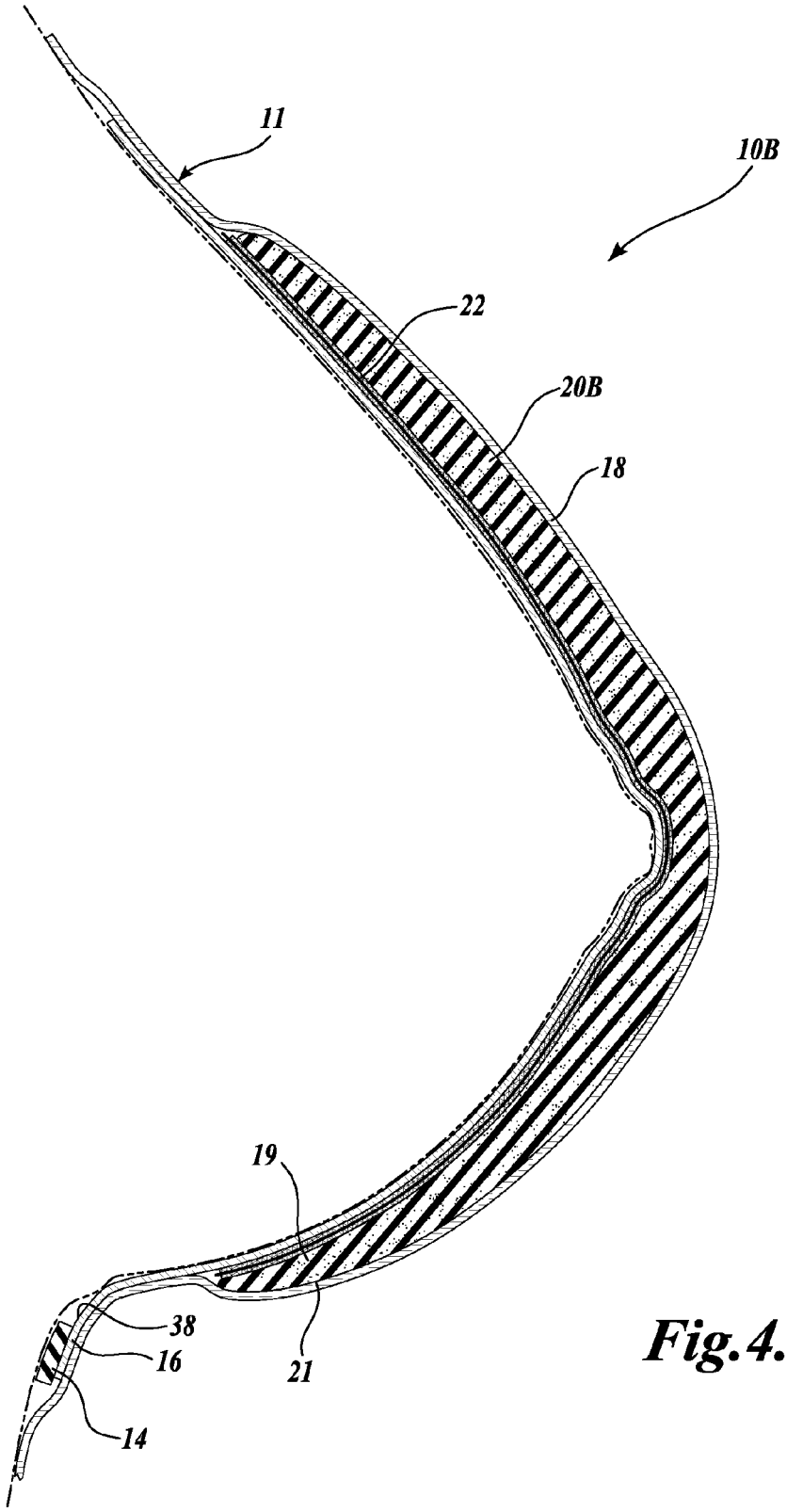
FIG. 4 is a cross sectional view of the garment, shelf bra, and one of the bra cup assemblies depicted in FIG. 2, wherein the cross sectional cut is taken substantially through SECTION 4-4 of FIG. 2 and a breast of the user is shown in phantom.

Referring to FIGS. 2, 4, and 5, an alternate embodiment formed in accordance with the present invention is depicted. This embodiment is identical in materials and operation with the above embodiment, with the exception that the bra pads 20A and 20B are adhered to an outer surface of the shelf bra 12, as opposed to an inner surface of the shelf bra 12 as described for the above embodiment.

Although the above embodiments are described in relation to a shelf bra 12 for illustrative purposes, it should be apparent to one skilled in the art that the bra pads 20A and 20B have wide application and are not limited to use with a shelf bra 12. For instance, the bra pads 20A and 20B may be adhered to many different types and portions of garments, such as directly to the inner surface of a top or to a lining of a garment, for example. However, preferably the bra pads 20A and 20B are adhered to a portion of a garment constructed from fabric having a sufficient thickness to cover any imperfections caused by the ironing on of the bra pads 20A and 20B.

In light of the above description of the components of the embodiments of FIGS. 1-5, the installation of the embodiments will now be described. Referring to FIG. 1, first a user heats an iron to a setting compatible for the garment to which the bra pads 20A and 20B will be attached. The user may then determine if the shape of the bra pads 20A and 20B needs to be modified. If modifications are required, they may be trimmed accordingly. If the garment is a shelf bra as depicted above, the user may then choose if the bra pads 20A and 20B will be adhered to the inner or outer surface of the shelf bra 12. A well known protective liner (not shown) coupled to one side of the bonding fabric 22 may be removed. The bonding fabric 22 may be applied to an inner adhering surface 19 of each of the bra pads 20A and 20B if the bra pads 20A and 20B are to be coupled to an outer surface of the shelf bra 12. If the bra pads 20A and 20B are to be coupled to an inner surface of the shelf bra 12, then the bonding fabric 22 may be coupled to an outer adhering surface 21 of the each of the bra pads 20A and 20B.

The garment may then be donned. A well known protective paper liner (not shown) coupled to the remaining side of the bonding fabric 22 may be removed. The bra pads 20A and 20B may then be positioned within the garment 11, and coupled to the garment 11 through firm hand pressure. The garment 11 may then be carefully removed and heat applied to the bra pads 20A and 20B until the temperature/heat sensitive adhesive has melted, permanently bonding the bra pads 20A and 20B to the garment 11. Once the garment 11 has cooled, the installation process is complete and the garment 11 may be worn.

Figure 6:
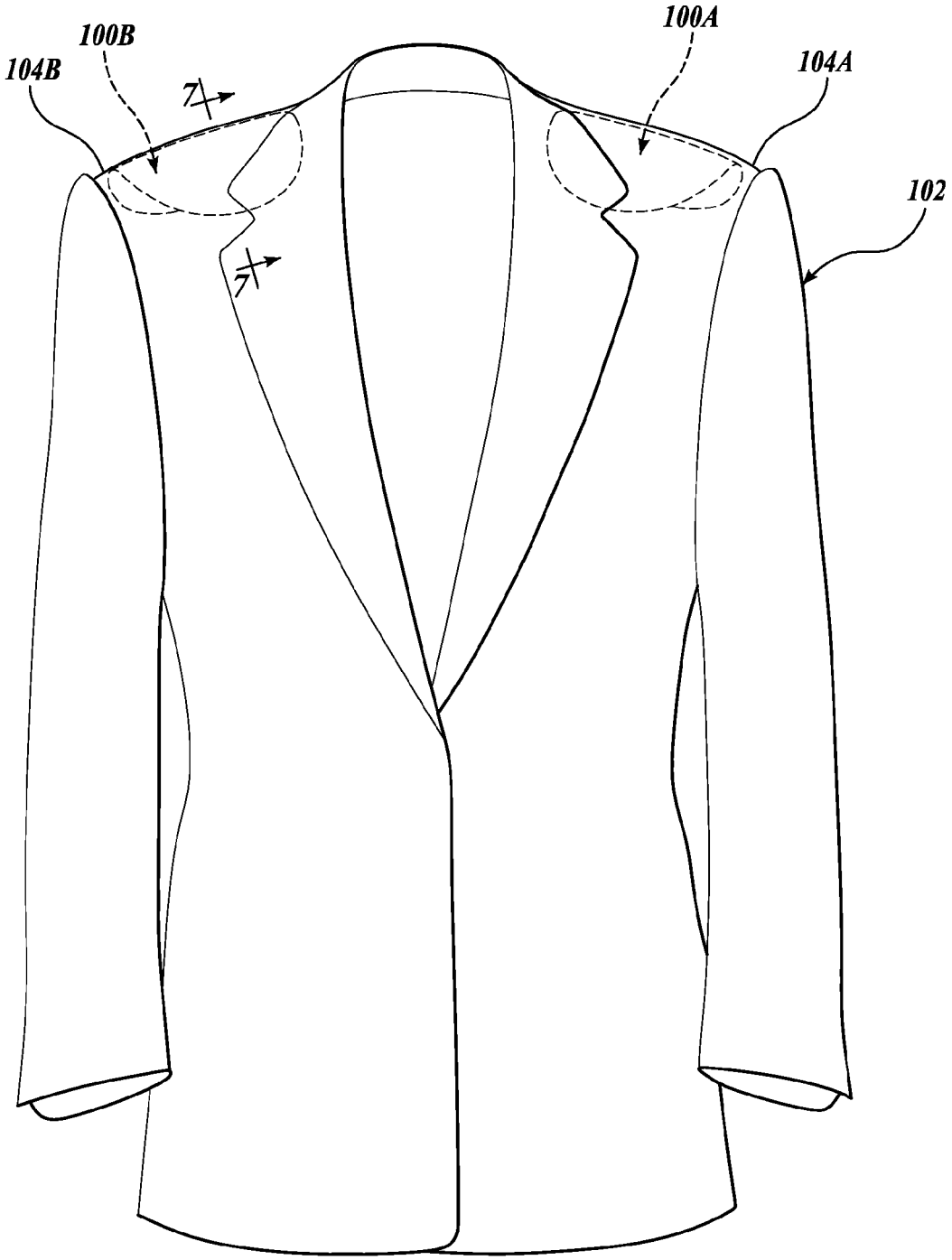
FIG. 6 is an elevation view of a garment outfitted with a pair of shoulder pad assemblies formed in accordance with one embodiment of the present invention, wherein the shoulder pad assemblies are depicted in hidden lines.
Figure 7:
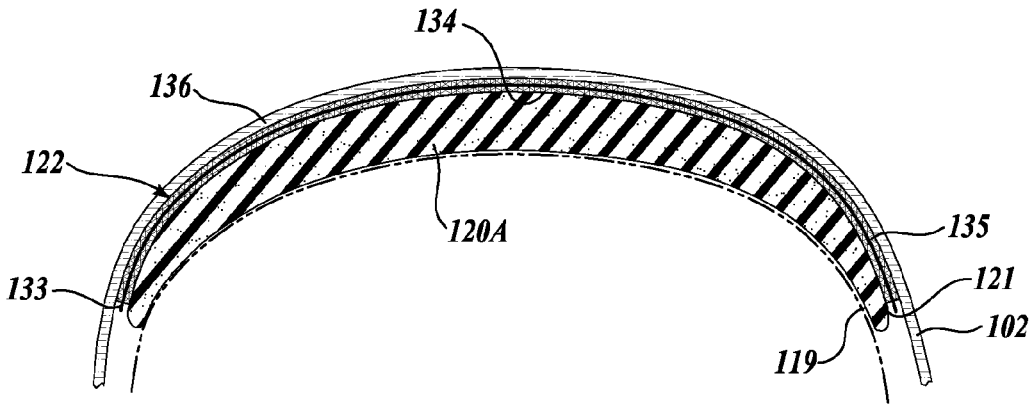
FIG. 7 is a cross sectional view of the garment and one of the shoulder pad assemblies depicted in FIG. 6, wherein the cross section cut is taken substantially through SECTION 7-7 of FIG. 6.
Figure 8:
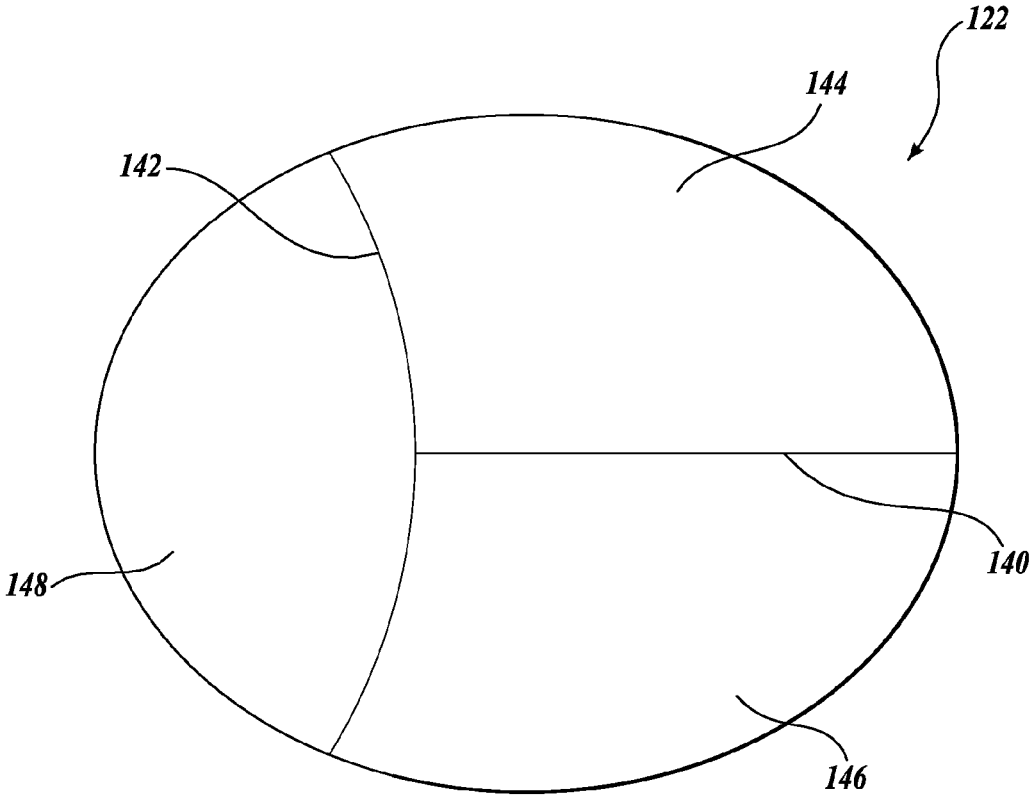
FIG. 8 is a top view of a section of bonding fabric formed in accordance with the present invention and suitable for use with the embodiment depicted in FIGS. 6 and 7.

Referring to FIGS. 6-8, a second alternate embodiment formed in accordance with the present invention is depicted. This embodiment is similar in materials and operation with the above described embodiments, with the exception that the bra pads of the above embodiment are replaced with a pair of shoulder pad assemblies 100A and 100B shaped to enhance the appearance of a wearer's shoulders, and that the garment pads are adhered to the shoulder portion 104A and 104B of a garment 102 instead of a shelf bra.

Referring to FIG. 8, the bonding fabric 122 of this embodiment may be dome shaped and may be formed from joining a back panel 144, a front panel 146, and an end panel 148 to one another. The back panel 144, shaped to conform to the back of a wearer's shoulder, is coupled to the front panel 146, shaped to conform to the front of the wearer's shoulder, along a center seam 140. The front and back panels 144 and 146 are joined to the end panel 148 along a shoulder seam 142 in such a manner to provide a dome shape to the bonding fabric 122. The shoulder seam 142 is oriented substantially parallel with the longitudinal length of the wearer's shoulders. Alternately, the bonding fabric 122 may be flat and shaped by the end user into a selected shape.

Referring to FIGS. 6 and 7, the bonding fabric 122 may be pre-cut by a manufacturer or cut by an end user in order to accommodate a variety of garments 102 and/or to provide a variety of aesthetically pleasing shapes to the garment 102. The bonding fabric 122 includes a support layer 133 having a pressure sensitive adhesive 134 applied to a first side so that the bonding fabric 122 may be hand-pressed onto an adhering surface 119 or 121 of the shoulder pads 120A and 120B. The bonding fabric 122 includes a pressure sensitive adhesive 135 applied to a second side. The bonding fabric 122 may be coupled to the garment 102 by hand-pressing the shoulder pad 120A or 120B against the pressure sensitive adhesive 135 applied to the second side of the support layer 133.

The pressure sensitive adhesive 134 provides a temporary hold while the user positions the shoulder pads 120A and 120B and their associated body portions 123 inside the garment 102. The temporary hold allows the shoulder pads 120A and 120B to remain in place until the user is ready to permanently bond the shoulder pads 120A and 120B to the garment 102. The bonding fabric 122 includes a temperature/heat sensitive adhesive applied to the first and second sides of the support layer. The heat sensitive adhesive may be activated by the application of heat, such as by use of an iron, to permanently bond the shoulder pads 120A and 120B to an inner surface 136 of the garment 102.

As should be apparent to one skilled in the art, the adherable shoulder pads 120A and 120B allow a wearer to adhere the shoulder pads 120A and 120B directly to their garment 102. This easy process rids the wearer of shoulder pad displacement or loss problems, avoids the hassles of sewing the shoulder pads 120A and 120B in place and, last but not least, allows the user to adhere alternately shaped shoulder pads 120A and 120B to a garment 102 to change the look of the garment, and/or allows a user to add shoulder pads 120A and 120B to a garment not originally supplied with shoulder pads.

The adherable shoulder pads 120A and 120B may be sold in combination with two pieces of bonding fabric 122 in a kit. Such a kit would provide a user with the ability to adhere the shoulder pads to a garment in a simple manner requiring very little, if any, skill.

Although in the above embodiments, the bonding fabric and/or adhesives are separate components subsequently adhered to a garment pad, it should be apparent to one skilled in the art that the bonding fabric and/or adhesives may be an integral part of the garment pad. Thus, as should be apparent to those skilled in the art, one of the pressure sensitive adhesive layers and/or the support layer may be eliminated.

Although in the above embodiments, pressure sensitive adhesive layers are described, it should be apparent to those skilled in the art that the pressure sensitive adhesive layers are optional and may be eliminated if desired.

Further, although the above embodiments are described for use with a bonding fabric, it should be apparent to those skilled in the art that the garment pads may be adhered to a garment through the use of an adhesive applied to the garment pad and/or garment and the use of the bonding fabric eliminated. For instance, a user may apply a liquid or spray adhesive to the garment pad to adhere, either permanently or temporarily, the garment pad to a garment. In one working embodiment, a urethane adhesive in liquid form is applied to the garment pad and the garment pad is pressed onto the garment. Once the urethane adhesive cures, the garment pad is thereby permanently adhered to the garment and the garment may be used in its normal manner.

Further still, although the above embodiments are described for use with a bonding fabric that is heat activated to permanently adhere the garment pad to the garment, it should be apparent to those skilled in the art that the heat activated adhesive may be eliminated. For instance, for the above described embodiments, the heat sensitive layer may be eliminated, and the bra pads semi-permanently or permanently adhered to the garment solely through the use of pressure sensitive adhesive applied between the garment pad and the garment at the location of attachment. For instance, a user may, in accordance with the present invention, use double stick adhesive or double-sided tape to apply a garment pad to the garment by placing the double stick adhesive between the garment and the garment pad and applying pressure, thereby coupling the garment pad to the garment.

The double stick adhesive may be arcuate in shape when in a planar configuration to aid in the forming of the double stick adhesive into a partial dome shaped configuration to match the shape of a dome shaped garment pad. The double stick adhesive may be in a form similar to the bonding fabric depicted in FIG. 5 and have relief cuts, relief gaps, and/or a center aperture disposed therein to aid in the formation of the double stick tape from a planar configuration to an arcuate or partial dome shaped configuration. In one actual embodiment, the double stick adhesive is formed from an elongate arcuate strip about 7" in length. The elongate arcuate strip has an inner radius of about 6" with the width of the strip varying from about 2.125" at a middle portion to about 1.75" at the ends. Relief cuts are disposed radially outward from the inner radius of the elongate arcuate strip to aid in the formation of the elongate arcuate strip from a planar configuration to a partial dome shaped configuration.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A bra pad assembly adapted to be selectively coupled to a garment that is not a brassiere, the bra pad assembly comprising:

(a) a three-dimensional permanent dome shaped bra pad defined by an inner seamless, continuous, unbroken curved concave surface and an outer seamless, continuous, unbroken curved convex adhering surface and a body portion extending between the inner seamless, continuous, unbroken curved concave surface and the outer seamless, continuous, unbroken curved convex adhering surface, wherein the body portion is a homogeneous foam solid having a thickness, wherein the bra pad is shaped to cup a breast of a user and provide shapeliness to the breast; and (b) an adhesive disposed on the outer seamless, continuous, unbroken curved convex adhering surface of the bra pad suitable for adhering the bra pad to a garment that is not a brassiere.

2. The bra pad assembly of claim 1, wherein the adhesive is a pressure sensitive adhesive adapted to temporarily couple the bra pad to a garment that is not a brassiere when subjected to a pressure.

3. The bra pad assembly of claim 1, wherein the bra pad is adapted to cup a breast of a user and provides the form of an enhanced shape of the breast of the user.

4. The bra pad assembly of claim 1, wherein the adhesive is a liquid adhesive that is curable to permanently couple the bra pad to a garment that is not a brassiere.

5. The bra pad assembly of claim 1, wherein no protrusions extend from the outer seamless, continuous, unbroken curved convex adhering surface of the bra pad.

6. A bra pad assembly adapted to be selectively coupled to a garment that is not a brassiere, the bra pad assembly consisting of:

(a) a three-dimensional permanent dome shaped bra pad defined by an inner seamless, curved, continuous, unbroken concave surface and an outer seamless, curved, continuous, unbroken convex adhering surface and a body portion extending between the inner seamless, curved, continuous, unbroken concave surface and the outer seamless, curved, continuous, unbroken convex adhering surface, wherein the body portion is a homogeneous foam solid having a thickness, wherein the bra pad is shaped to cup a breast of a user and provide shapeliness to the breast; and (b) an adhesive disposed on the outer seamless, curved, continuous, unbroken convex adhering surface of the bra pad suitable for adhering the bra pad to a garment that is not a brassiere.

7. The bra pad assembly of claim 6, wherein the adhesive is a pressure sensitive adhesive adapted to temporarily couple the bra pad to a garment that is not a brassiere when subjected to a pressure.

8. The bra pad assembly of claim 6, wherein the adhesive is a pressure sensitive adhesive adapted to permanently couple the bra pad to a garment that is not a brassiere when subjected to a pressure.

9. The bra pad assembly of claim 6, wherein the adhesive is a liquid adhesive that is curable to permanently couple the bra pad to a garment that is not a brassiere.

10. A method of providing shapeliness to a breast without the use of a brassiere, the method comprising:

(a) providing a bra pad assembly, comprising:

(i) a three-dimensional permanent dome shaped bra pad defined by an inner seamless, curved, continuous, unbroken concave surface and an outer seamless, curved, continuous, unbroken convex adhering surface and a body portion extending between the inner seamless, curved, continuous, unbroken concave surface and the outer seamless, curved, continuous, unbroken convex adhering surface, wherein the body portion is a homogeneous foam solid having a thickness, wherein the bra pad is shaped to cup a breast of a user and provide shapeliness to the breast; and (ii) an adhesive disposed on the outer seamless, curved, continuous, unbroken convex adhering surface of the bra pad;

(b) positioning the bra pad within an interior portion of a garment that is not a brassiere such that the inner seamless, curved, continuous, unbroken concave surface of the bra pad is positioned to engage and provide shapeliness to a breast; and (c) applying pressure to one of the bra pad and the garment to adhere the outer seamless, curved, continuous, unbroken convex adhering surface of the bra pad to an interior surface of the garment.

11. The bra pad assembly of claim 10, wherein the adhesive is a pressure sensitive adhesive adapted to temporarily couple the bra pad to a garment that is not a brassiere when subjected to a pressure.

12. The bra pad assembly of claim 10, wherein the adhesive is a pressure sensitive adhesive adapted to permanently couple the bra pad to a garment that is not a brassiere when subjected to a pressure.

* * * * *